US007596925B2

(12) United States Patent
Yuyama et al.

(10) Patent No.: US 7,596,925 B2
(45) Date of Patent: Oct. 6, 2009

(54) MEDICINE DELIVERING DEVICE

(75) Inventors: Shoji Yuyama, Osaka (JP); Satoshi Asada, Osaka (JP); Hiroki Kobayashi, Osaka (JP)

(73) Assignee: Yuyama Mfg. Co., Ltd., Toyonaka-shi (JP)

( * ) Notice: Subject to any disclaimer, the term of this patent is extended or adjusted under 35 U.S.C. 154(b) by 7 days.

(21) Appl. No.: 11/576,888

(22) PCT Filed: Oct. 6, 2005

(86) PCT No.: PCT/JP2005/018571

§ 371 (c)(1),
(2), (4) Date: Apr. 9, 2007

(87) PCT Pub. No.: WO2006/041016

PCT Pub. Date: Apr. 20, 2006

(65) Prior Publication Data

US 2008/0029530 A1 Feb. 7, 2008

(30) Foreign Application Priority Data

Oct. 8, 2004 (JP) ..... 2004-297024

(51) Int. Cl.
*B65B 61/26* (2006.01)
*B65B 61/02* (2006.01)
*B65C 9/00* (2006.01)

(52) U.S. Cl. ..... 53/131.5; 53/411; 53/128.1; 156/384; 156/DIG. 24

(58) Field of Classification Search ..... 53/131.1–131.5, 53/411, 419; 156/350, 351, 367, 384, 194
See application file for complete search history.

(56) References Cited

U.S. PATENT DOCUMENTS 4,559,755 A * 12/1985 Romagnoli ..... 53/64
4,707,211 A * 11/1987 Shibata ..... 156/354
5,121,586 A * 6/1992 Focke ..... 53/136.4
5,251,988 A * 10/1993 Frazier ..... 400/618
5,371,521 A * 12/1994 Wehrmann ..... 347/171
5,468,080 A * 11/1995 Jones ..... 400/618

(Continued)

FOREIGN PATENT DOCUMENTS

CN 1511760 A 7/2004

(Continued)

*Primary Examiner*—Paul R Durand
(74) *Attorney, Agent, or Firm*—Oblon, Spivak, McClelland, Maier & Neustadt, L.L.P.

(57) ABSTRACT

A medicine delivering device permits additional medicine cassettes to be provided at low cost without greatly enlarging the installation space. The medicine delivering device includes a medicine storage and removal unit in which many medicine cassettes each containing a medicine are detachably provided to the outer surface of a drum whose upper and lower ends are rotatable supported by the device body and a medicine packaging unit that packages medicine removed through a collecting hopper from the medicine cassette of the medicine storage and removal unit. There is provided on the side surface of the device body a sub medicine storage and removal unit including: a body; a drawer body provided to be capable of being pulled out from the body and that is detachably provided with a plurality of medicine cassettes each containing the medicine; and a guide that guides the medicine taken out from the medicine cassette to the collecting hopper.

14 Claims, 16 Drawing Sheets

U.S. PATENT DOCUMENTS

| | | | | |
|---|---|---|---|---|
| 5,839,257 | A * | 11/1998 | Soderstrom et al. | 53/411 |
| 6,067,103 | A * | 5/2000 | Ewert et al. | 347/171 |
| 6,145,436 | A * | 11/2000 | Natalizia et al. | 101/288 |
| 6,216,418 | B1 * | 4/2001 | Kim | 53/131.5 |
| 6,357,941 | B1 * | 3/2002 | Amano et al. | 60/761 |
| 6,810,801 | B2 * | 11/2004 | Murdter | 101/288 |
| 2004/0034447 | A1 | 2/2004 | Vollm | |
| 2004/0112911 | A1 | 6/2004 | Kim | |
| 2004/0134043 | A1 | 7/2004 | Uema et al. | |

FOREIGN PATENT DOCUMENTS

| | | |
|---|---|---|
| EP | 0 945 117 A2 | 9/1999 |
| JP | 6 320766 | 11/1994 |
| JP | 2000 203541 | 7/2000 |
| JP | 2001 260506 | 9/2001 |
| WO | WO 00/32477 | 6/2000 |

* cited by examiner (a)

(b)

(a)

(b)

(a)

(b)

MEDICINE DELIVERING DEVICE

TECHNICAL FIELD OF THE INVENTION

The present invention relates to a medicine delivering device, and more specifically, to a printer in which an ink ribbon can be easily detached and attached.

BACKGROUND ART

Conventionally, as indicated in patent document 1, a medicine delivering device is known which is composed of: a drum-type medicine storage and take-out part that is fitted with many medicine cassettes; and a medicine packaging part that packages a medicine taken out from the medicine storage and take out part. There are two types of medicine delivering device: a large-size type that includes approximately 150 to 300 fit table medicine cassettes; and a small-size type that includes 150 or less medicine cassettes. Thus, a medicine delivering device of an appropriate size is selected in accordance with a supply of a medicine demanded by a medicine store or a pharmaceutical department at a hospital where the medicine delivering device is used. At a small medicine store or a small hospital, in terms of reducing the installation space, a small-size medicine delivering device is preferred which has a small drum diameter that permits a minimum number of medicine cassettes.

Patent Document 1 Japanese Unexamined Utility Model Publication No. 1991-35003.

SUMMARY OF THE INVENTION

Problem to be Solved by the Invention

However, with a small-size medicine delivering device, the number of existing medicine cassettes may become unsatisfactory due to expansion of the medicine store or the hospital an increase in the number of patients introduction of a new medicine or the like. In such a case purchasing a large-size medicine delivering device requires high costs and also increases the installation space.

Thus, it is an object of the invention to provide a medicine delivering device which permits additional medicine cassettes to be provided at low cost without greatly enlarging the installation space.

Means for Solving the Problem

To achieve the object described above, the present invention refers to a medicine delivering device having a medicine storage and removal unit in which many medicine cassettes each containing medicine are detachably provided to the outer surface of a drum whose upper and lower ends are rotatably supported by the device body and a medicine packaging unit that packages a medicine removed through a collecting hopper from the medicine cassette of the medicine storage and removal unit. There is provided on the side surface of the device body a sub medicine storage and removal unit including: a body; a drawer body that is so provided as to be capable of being pulled out from the body and that is detachably provided with a plurality of medicine cassettes each containing medicine; and a guide that guides the medicine taken out from the medicine cassette to the collecting hopper.

According to the configuration described above, additional medicine cassettes can be provided at low cost without greatly enlarging the installation space.

It is preferable that the medicine cassette of the drawer body be arranged on the side surface of the drawer body.

In this case, the medicine cassette may be further provided on the front surface of the drawer body.

It is preferable that, above the guide, a shutter be provided which receives a medicine taken out from the medicine cassette of the drawer body.

It is preferable that, between the collecting hopper and the guide, a transfer device be provided which transfers the medicine collected in the guide to the collecting hopper.

Further, conventional medicine delivering devices comprise a printer that performs, by use of an ink ribbon, predetermined printing of a patient name, a dose period, dose regimen, and the like on packaging paper for packaging the medicine. In installation of the ink ribbon into the printer, it is required to insert an ink tape of the ink ribbon between a printer head and a backup roller thereof. With a conventional printer of the medicine delivering device, the interval between the printer head and the backup roller thereof is very narrow, thus making it difficult to insert the ink tape therebetween, Thus, the present invention refers to a medicine delivering device including a printer that performs predetermined printing, by use of the ink ribbon, on the packaging paper for packaging the medicine The medicine delivering device includes:

a stationary member that is provided in a device body, a movable member that is movably provided to the stationary member, a printer head that is swingably provided to the movable member, a backup roller that is provided to the stationary member and that opposes the printer head, an ink ribbon that is detachably provided to the movable member and that guides an ink tape to the printer head, and a tension bar that is swingably provided o the stationary member and that presses the ink tape to thereby adjust a tensile force thereof. In the medicine delivering device, a swinging mechanism is further provided which swings the printer head and the tension bar in mutually opposing directions when the movable member moves. More specifically, the present invention refers to the medicine delivering device including the printer that performs predetermined printing, by use of the ink ribbon, on packaging paper for packaging the medicine. The medicine delivering device includes.

the stationary member that is provided in the device body, the movable member that is movably provided to the stationary member, the printer head that is swingably provided to the movable member, the backup roller that is provided to the stationary plate member and that opposes the printer head, the ink ribbon that is detachably provided to the movable member and that guides the ink tape to the printer head, the tension bar that is swingably provided to the stationary member and that presses the ink tape to thereby adjust the tensile force thereof, the printer head swinging mechanism that swings the printer head so that the printer head approaches toward the backup roller via the packaging paper and the ink ribbon when the movable member is moved so that the printer head advances toward the backup roller and that swings the printer head so that the printer head separates from the backup roller when the movable member is moved so that the printer head retreats from the backup roller, and a tension bar swinging mechanism that swings the tension bar so that the tension bar presses the ink tape in the direction opposite to the direction in which the printer head moves when the movable member is moved so that the printer head advances toward the backup roller and that swings the tension bar so that the tension bar separates from the ink tape in the direction opposite to the direction in which the printer head moves when the movable member is moved so that the printer head retreats from the backup roller.

According to the configuration described above, when the movable member is moved so that the printer head retreats from the backup roller, the printer head swings so as to separate from the backup roller, and the tension bar swings so as to separate from the ink tape in the opposite direction to the direction in which the printer head moves. Since the gap between the printer head and the backup roller widens and the tension bar separates from the ink tape, the ink tape can be more easily inserted between the printer head and the backup roller After the ink ribbon is fitted, when the movable member is moved so that the printer head advances toward the backup roller, the printer head approaches the backup roller via the packaging paper and the ink ribbon, and the tension bar swings so as to press the ink tape in the opposite direction to the direction in which the printer head moves, thus permitting printing with the ink ribbon.

It is preferable that the printer head swinging mechanism include:

a holding member that holds the printer head, a support shaft that rotatably fits the holding member to the movable member and that swingably supports the printer head an actuating lever that is fitted to the support shaft, and a first and a second projecting pieces that are fitted to the stationary member and that contact with a part of the actuating lever when the movable member advances and retreats.

It is preferable that the tension bar swinging mechanism include:

a swinging lever that holds the tension bar and that is rotatably fitted via the support shaft to the movable member, a biasing member that biases the tension bar in the direction in which the ink tape is pressed, and a contact piece that is fitted to the stationary member and that contacts with a part of the swinging lever when the movable member retreats.

It is preferable that, in the medicine delivering device, the movable member is provided with the pressing member that is provided adjacently to the printer head and that presses, against the backup roller, a portion of the packaging paper located on a side opposite to a side of a portion thereof opposing the printer head with respect to a line folding the packaging paper in half. In this case, it is preferable that the pressing member is provided to the support shaft of the printer head and is biased by the biasing member in the direction in which the backup roller is pressed.

Effect of the Invention

According to the present invention, providing the sub medicine storage and removal unit on the side surface of the device body permits additional medicine cassettes to be provided at low costs without greatly enlarging the installation space. Further, according to the present invention, when the movable member is moved so that the printer head retreats from the backup roller, the gap between the printer head and the backup roller widens and the tension bar separates from the ink tape. This permits the ink tape to be more easily inserted between the printer head and the backup roller and thus permits the ink ribbon to be more easily detached and attached.

PREFERRED EMBODIMENTS OF THE INVENTION

FIG. 1 shows a medicine delivering device 1 according to the present invention This medicine delivering device 1 comprises a device body 2, a medicine storage and removal unit 3, a medicine packaging unit 4, and a sub medicine storage and removal unit 5.

The device body 2 has a vertically long cubic shape, has a front upper portion and a front lower portion thereof provided with doors 6 and 7 respectively, and has a central portion thereof drawably provided with a manual medicine distributor 8. The upper door 6 is provided with an operation panel 9 and a journal printer 10 for printing medicine data and the like when the manual medicine distributor 8 is used. The lower door 7 is provided with a discharge port 11 for discharging a belt of medicine package from the medicine packaging unit 4 The upper door 6 is further provided with a bar code reader 9*a*, so that, when a bar code written on an original box containing a medicine is held against this bar code reader 9*a*, a medicine cassette 13, to be described below, for this medicine moves to the front side of the door 6.

The medicine storage and removal unit 3 has, as shown in FIG. 2, has a drum 12 whose upper and lower ends are rotatably fitted to the device body 2. To the external surface of the drum 12, support stands 14, to which medicine cassettes 13 are fitted, are arranged circumferentially and also vertically in multiple stages. The medicine cassette 13 stores the medicine therein and has a well-known structure that is capable of discharging medicines one by one thorough rotation of a rotor. The medicine discharged from the medicine cassette 13 is guided through a passage provided on the inner surface of the drum 12 to an upper collecting hopper 15 to be described below.

The medicine packaging unit 4 has on an upper portion thereof the upper collecting hopper 15, a lower collecting hopper 16, and a packaging hopper 17, as shown in FIG. 7 The upper collecting hopper 15 receives medicines taken out from the respective medicine cassettes 13 of the medicine storage and removal unit 3. The lower collecting hopper 16 consists of as shown in FIG. 4, a first hopper part 19 for receiving the medicine dropping from the manual medicine distributor 8; and a second hopper part 20 for receiving the medicine dropping from the upper collecting hopper 15 and a medicine extruded from the sub-medicine storage and removal unit 5. The first hopper part 19 has as shown in FIG. 4, a pyramid-like shape, and has therein a first divider plate 21 vertically oriented, second divider plates 22 provided on both sides of the first divider plate 21 in a tilted manner, and third divider plates 23 respectively formed between the second divider plates 22 and the side walls. These divider plates prevent a medicine dropping on the wall surface of the first hopper part 19 from bouncing, and thus prevent an increase in the drop time. The second hopper part 20 is provided on the outer side of the first hopper part 19, and has a common exit therewith. The packaging hopper 17 is detachably provided below the lower collecting hopper 16, and introduces medicine dropping from the lower collecting hopper 16 to packaging paper 26 to be described below. FIG. 11 shows the positional relationship among the lower collecting hopper 16, the manual medicine distributor 8 located thereabove, the upper collecting hopper 15, and a tablet extruding unit 44. The manual medicine distributor 8 is located above the first hopper part 19 of the lower collecting hopper 16 shown in FIG. 4. The exits of the upper collecting hopper 15 and the tablet extruding unit 44 are located above the second hopper part 20 shown in FIG. 4.

As shown in FIG. 3, in the right lower portion of the medicine packaging unit 4, a roll 25 of the packaging paper 26 is fitted. The packaging paper 26 rewound from the roll 25 is guided to a printer unit 27, where information, such as a patient name, a medicine name, dose date and time, and the like, is printed. The packaging paper 26 that has passed through the printer unit 27 with the predetermined information printed thereon is folded in half by a triangular plate 28 in such a manner as to open upward, and then receives the medicine discharged from the packaging hopper 17. The packaging paper 26 that has received the medicine is guided to a heat roller 29, where the packaging paper 26 is sealed vertically and horizontally, whereby the received medicine is sequentially received and reeled out obliquely downward as a packaging band 26'. The packaging band 26' is conveyed obliquely upward by a conveyor, not shown, and discharged from the discharge port 11 provided in the door. In the figure, in the left upper portion of the medicine packaging unit 4, there are provided the printer unit 27 and an operation panel 30 for adjusting the heat roller 29.

The printer unit 27 consists of: a stationary plate 31; a movable plate 33 movably provided along a rail 32 provided to the stationary plate 31; a printer head 35 swingably provided to the movable plate 33 via a shaft 34; a backup roller 36 provided to the stationary plate 31 and opposing the printer head 35; an ink ribbon 38, detachably provided to the movable plate 33, which guides an ink tape 37 to the printer head 35; and a tension bar 39 movable in parallel to the direction of movement of the movable plate 33, that presses the ink tape 37 against the stationary plate 31 to thereby adjust the tension thereof. The printer unit 27 will be described in detail below.

The sub medicine storage and removal device 5 consists of, as shown in FIG. 5, a main body 40, a drawer body 41, an upper guide 42, a lower guide 43, and the medicine extruding unit 44.

The main body 40 has a vertically elongated rectangular parallelepiped shape whose height and width is equal to those of the device body 2 and whose horizontal width is narrower than that of the device body 2. This main body 40 is fitted to the right side surface of the device body 2, but may alternatively be fitted to the left side surface thereof To the upper half of the main body 40 as viewed from the front, a door 40*a* is fitted.

The drawer body 41 has a first support plate 45 oriented parallel to the drawing direction, and a second support plate 46 oriented orthogonal to the first support plate 45. To the left surface of the first support plate 45, support stands 14, to which medicine cassettes 13 are fitted, are arranged in the anteroposterior direction and also in multiple stages in the vertical direction. To the front surface of the second support plate 46 also, support stands 14, to which medicine cassettes 13 are fitted, are arranged in multiple stages in the vertical direction. The medicine cassette 13 has the same structure as that of the medicine cassette 13 of the medicine storage and removal unit 3. The medicine discharged from the medicine cassette 13 is guided to the upper guide 42 to be described below through passages provided on the back surfaces of the first and second support plates 45 and 46.

The upper guide 42 has a shutter 47 for receiving medicine dropping from the medicine cassette 13 of the drawer body 41.

The lower guide 43 is so formed as to be increasingly bent toward the device body 2 as it approaches a more downward position, and guides medicine dropping from the upper guide 42 to the medicine extruding unit 44 to be described below.

The medicine extruding unit 44 consists of: as shown in FIG. 10, a guide rail 49 laterally projecting from a base stand 48 and having a channel cross section, a slide container 50 slidably provided to the guide rail 49 and having a rectangular shape, a link mechanism 51 for sliding the slide container 50 along the guide rail 49, and a motor 52 for driving the link mechanism 51 The slide container 50 opens upward, and has an opening 53 formed at the bottom thereof. Above the slide container 53, fitted to the guide rail 49 is a frame 54 with which the lower end opening of the lower guide 43 engages. As shown in FIG. 10B, when the slide container 50 retreats, medicine from the lower guide 43 is stored into the slide container 50. When the motor 52 is driven to thereby advance the slide container 50 via the link mechanism 51, upon separation of the opening 53 of the slide container 50 from the guide rail 49, the medicine contained in the slide container 50 drops from the opening 53, whereby the medicine is collected in the lower collecting hopper 16 of the device body 2.

FIGS. 12 to 16 show the details of the printer unit 27. To the stationary plate 31, as shown in FIG. 12, a first projecting piece 55*a* and a second projecting piece 55*b*, with each of which a roller 64 of an actuating lever 63 of the printer head 35 to be described below contacts, are fitted To the stationary plate 31, as shown in FIG. 13, a contact piece 56 is also fitted with which a roller 80 of a swinging lever 76 of the tension bar 39 to be described below contacts In addition, to the stationary plate 31, micro-switches 57*a* and 57*b* are fitted which detect the location of the movable plate 33. Further, to the stationary plate 31, a catch 58 is fitted which holds the movable plate 33 at a predetermined position.

The movable plate 33 can be, as shown in FIG. 16, moved by a drive motor 59 and a rack and pinion mechanism 60 between the fitting position on the left hand side and the replacement position on the right hand side as viewed in the figure. Hereinafter, movement toward the fitting position on the left hand side in the figure is referred to as an advance while movement toward the replacement position on the right hand side in the figure is referred to as a retreat. The fitting position and the replacement position are detected by the micro-switches 57*a* and 57*b*, respectively. To the movable plate 33, an engaging projection 61 is provided which engages at the fitting position with the catch 58 provided to the stationary plate 31.

As shown in FIGS. 12 and 13, the printer head 35 is held by a holding plate 62 which is rotatably supported by the movable plate 33 via the support shaft 34. To an end portion of the support shaft 34, the actuating lever 63 is fitted which extends upward. To the leading end of the actuating lever 63, the roller 64 is fitted. The roller 64 of the actuating lever 63 is located between the first projecting piece 55*a* and the second projecting piece 55*b* of the stationary plate 31 In addition, to the support shaft 34, a stationary lever 65 is fitted which extends downward. To the stationary lever 65, a movable lever 66 is rotatably fitted. To the leading end of the movable lever 66, a pressing member 67 of a roller type is fitted which opposes the backup roller 36. The movable lever 66 is biased toward the backup roller 36 by a torsion spring 68. Further, to the support shaft 34, a drive lever 69 is fitted which extends in the retreat direction. The drive lever 69 is biased by a coil spring 70 in the direction in which the printer head 35 separates from the backup roller 36. The drive lever 69 causes, via a solenoid 71 fitted to the movable plate 33 the printer head 35 to press against the backup roller 36 against a basing force of the coil spring 70 during printing.

The backup roller 36 is rotatably fitted to the stationary plate 31 so as to oppose the printer head 35 and the pressing member 67.

The ink ribbon 38 has a take-up reel 72 in which the ink tape 37 is wound and a rewinding reel 73 that rewinds the ink tape 37 rewound from the take-up real 72, and is so constructed as to be attachable and detachable by inserting and detaching drive shafts 74 and 75 provided to the movable plate 33 in and from the reels 72 and 73.

The tension bar 39 is cantilever-supported by the swinging lever 76, which is swingably fitted to the movable plate 33 via a support shaft 77. The swinging lever 76 is biased by a coil spring 78 in such a direction as to separate from the backup roller 36, as shown in FIG. 16A. In the middle of the swinging lever 76, a roller shaft 79 is so provided as to project toward the stationary plate 31 To this roller shaft 79, the roller 80 is fitted which contacts to the contact piece 56 of the stationary plate 31.

The take-up reel 72 and the rewinding reel 73 of the ink ribbon 38 are driven by a drive motor, not shown As shown in FIG. 15, the ink tape 37 rewound from the take-up reel 72 passes through a first support roller 81 provided to the movable plate 33 and then through the gap between the backup roller 36 and the printer head 35, travels around the tension bar 39, passes through a second support roller 82 provided to the movable plate 31, and then is taken up by the rewinding reel 73.

In the medicine delivering device 1 with the structure as described above, medicine taken out from the medicine cassette 13 of the sub medicine storage and removal device 5 is temporarily received by the shutter 47 of the upper guide 42. When the shutter 47 opens the medicine is guided to the medicine extruding unit 44 through the lower guide 43. The medicine extruded from the medicine extruding unit 44 is guided to the lower collecting hopper 16, where the medicine joins a medicine guided from the medicine storage and removal unit 3 or the manual medicine distributor 8 of the device body 2. Then when a shutter 24 of the lower collecting hopper 16 opens, the medicine is guided to the packaging paper 26 through the packaging hopper 17, sealed by the heater roller 29, and discharged as the packaging band 26' from the discharge port 11 of the device body 2.

In replacement of the medicine cassette 13 of the sub medicine storage and removal device 5, the door 40*a* of the main body 40 is opened and the drawer body 41 is pulled forward, whereby the medicine cassette 13 appears on the side surface, thus permitting replacement. Moreover, even while the medicine cassette 13 of the sub medicine storage and removal device 5 is performing dispensing operation, the door 40*a* of the main body 40 can be opened to replace the medicine cassette 13 located on the front surface, thus not requiring suspension of the dispensing operation.

The sub medicine storage and removal device 5 is provided on the side surface of the device body 2 of the medicine delivering device 1 in this manner. Therefore, when medicines can no longer be stored only with the medicine cassettes 13 (for example, 130 cassettes) of the medicine storage and removal device 3 on the device body 2 side, providing the sub medicine storage and removal device 5 permits additional 32 medicine cassettes 13 to be provided. This eliminates the need for purchasing a new large-size medicine delivering device and permits providing additional medicine cassettes 13 at low costs without greatly enlarging the space.

Pressing an arrow button 30*a* on the right on the operation panel 30 shown in FIG. 3 drives the drive motor 59 shown in FIG. 16, so that the rack and pinion mechanism 60 moves the movable plate 33 from the fitting position to the replacement position. As a result, the ink ribbon 38 moves rightward in FIG. 15. Through contact between the roller 64 of the actuating lever 63 and the first projecting piece 55*a* of the stationary plate 31 shown in FIG. 16, the printer head 35 moves rightward with respect to the support shaft 34 as a center to thereby separate from the backup roller 36, as shown in FIG. 16B. Concurrently, the pressing member 67 of the support shaft 34 also moves rightward to thereby separate from the backup roller 36. Meanwhile, through contact between the roller 80 of the roller shaft 79 and the contact piece 56 of the stationary plate 31, the tension bar 39 moves leftward, opposite to the movement of the printer head 35, with respect to the support shaft 34 as a center, as shown in FIG. 16B. As a result, as shown in FIG. 15B, the gap between the printer head 35 and the backup roller 36 widens and the tension bar 39 separates from the ink tape 37. This, therefore eliminates the need for insertion of the ink tape 37 between the backup roller 36 and the printer head 35 and also the need for winding the ink tape 37 around the tension bar 39 at the time of replacement of an old ink ribbon 38 with a new ink ribbon 38, thus permitting easy replacement operation for the ink ribbon 38.

After a new ink ribbon 38 is fitted, pressing an arrow button 30*b* on the left on the operation panel 30 shown in FIG. 3 reversely drives the drive motor 59 shown in FIG. 16, so that the rack and pinion mechanism 60 moves the movable plate 33 to the fitting position. As a result, the ink ribbon 38 moves leftward in FIG. 15. Through contact between the roller 64 of the drive lever 63 and the second projecting piece 55*b* of the stationary plate 31 shown in FIG. 16, the printer head 35 moves leftward with respect to the support shaft 34 as a center to thereby press against the backup roller 36 via the ink tape 37 and the packaging paper 26, as shown in FIG. 16A. Concurrently, the pressing member 67 of the support shaft 34 also moves leftward and presses the backup roller 36 by a biasing force of the torsion spring 68. Meanwhile, through separation of the roller 80 of the roller shaft 79 from the contact piece 56 of the stationary plate 31, the tension bar 39 moves rightward, opposite to the movement of the printer head 35, as shown in FIG. 16A, and presses the ink tape 37 by a biasing force of the coil spring 78. This, therefore, requires no special mechanism and operation for pressing the tension bar 39 against the ink tape 37.

When the movable plate 31 moves from the replacement position to the fitting position shown in FIG. 16B, the engaging projection 61 of the movable plate 31 engages with the catch 58 of the stationary plate 31, whereby the movable plate 31 is securely held at the fitting position.

As shown in FIG. 14, the packaging paper 26 has one side thereof, with respect to the center located at the center line when folded in half, pressed by the printer head 35 against the backup roller 36, and the other side thereof pressed by the plate type pressing member 67 against the backup roller 36. Both sides of the packaging paper 26 are evenly pressed against the backup roller 36 in this manner; therefore, the packaging paper 26 does not become skewed while passing through the backup roller 36, which prevents misalignment between the two side edges of the packaging paper 26 when folded in half, thus eliminating sealing failure

REFERENCE NUMERALS

Figure 1:
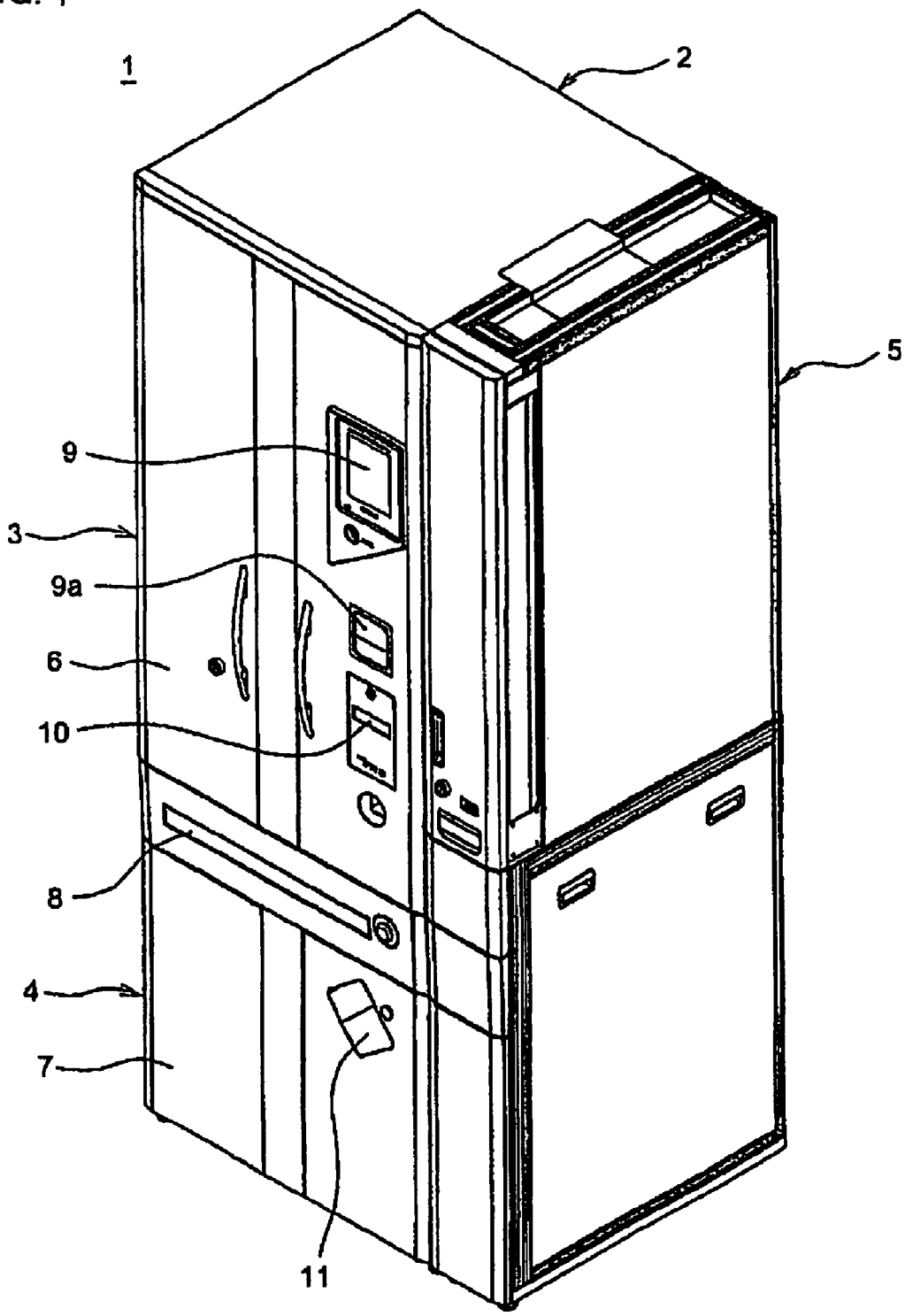
FIG. 1 is a perspective view of a medicine delivering device.
Figure 2:
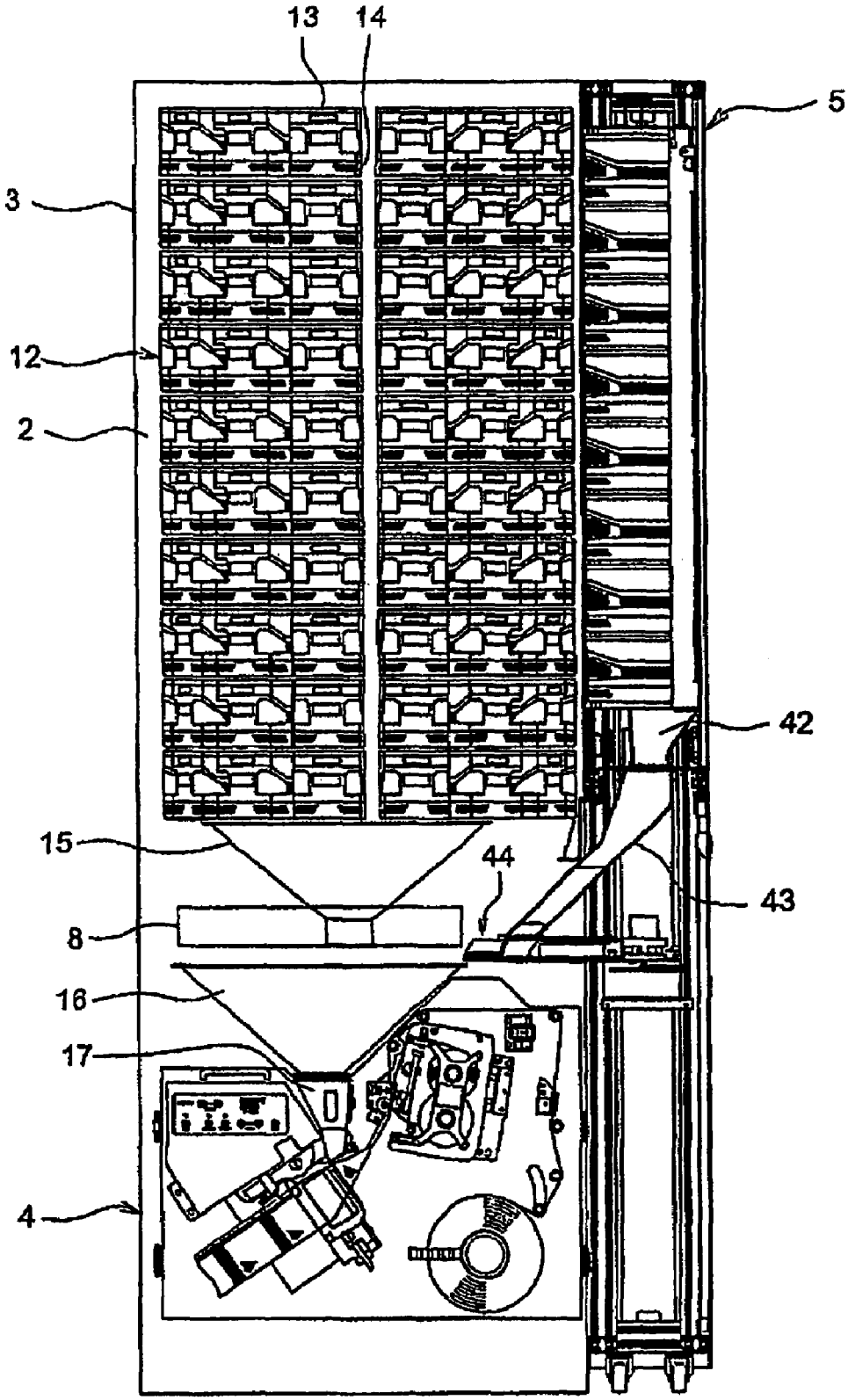
FIG. 2 is a perspective side view of the interior of the medicine delivering device.
Figure 3:
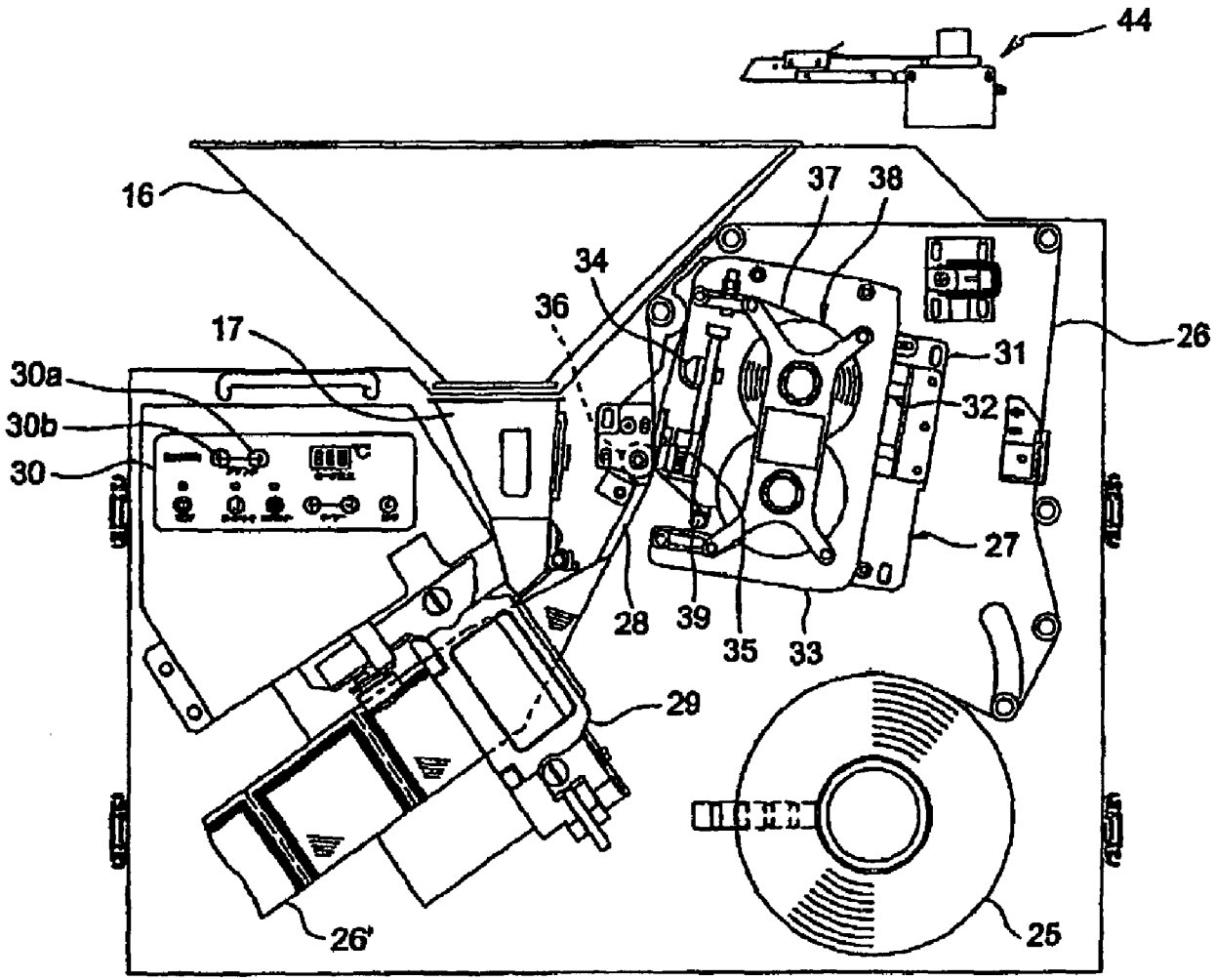
FIG. 3 is an elevation view of a medicine packaging unit
Figure 4:
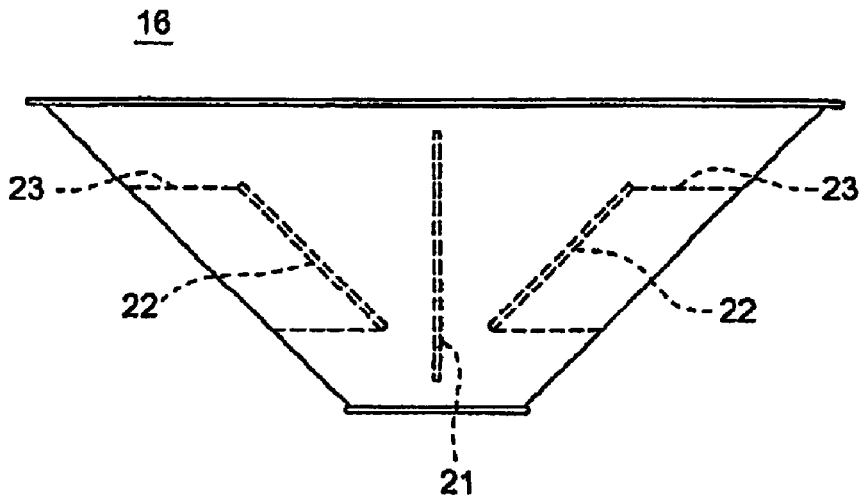
FIG. 4A is an elevation view of a packaging hopper.
FIG. 4B is a plan view thereof
Figure 4:
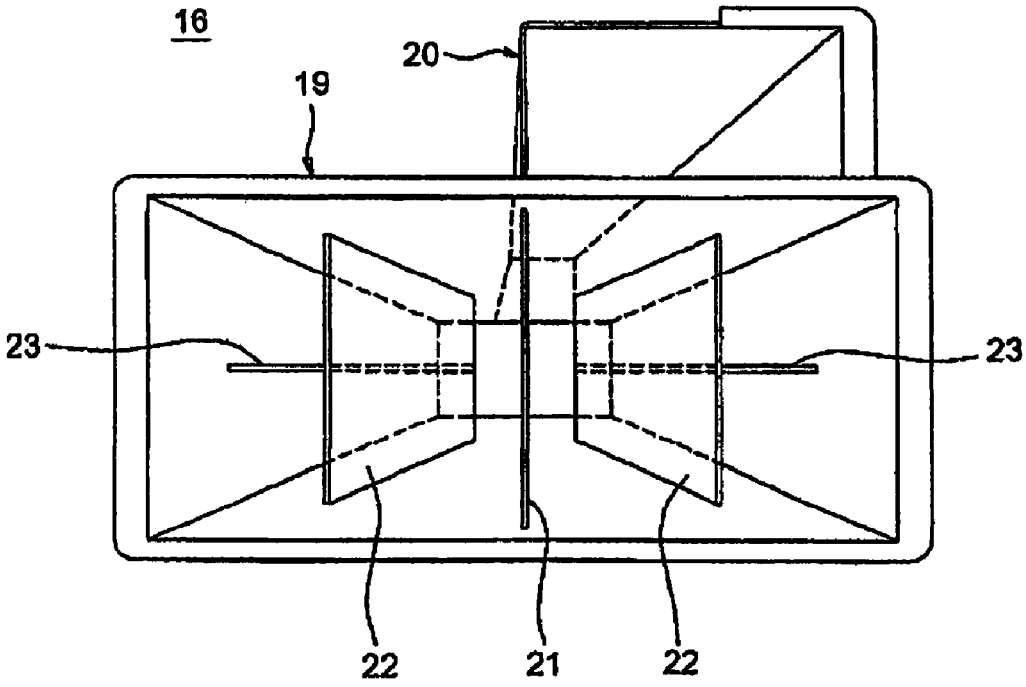
Figure 5:
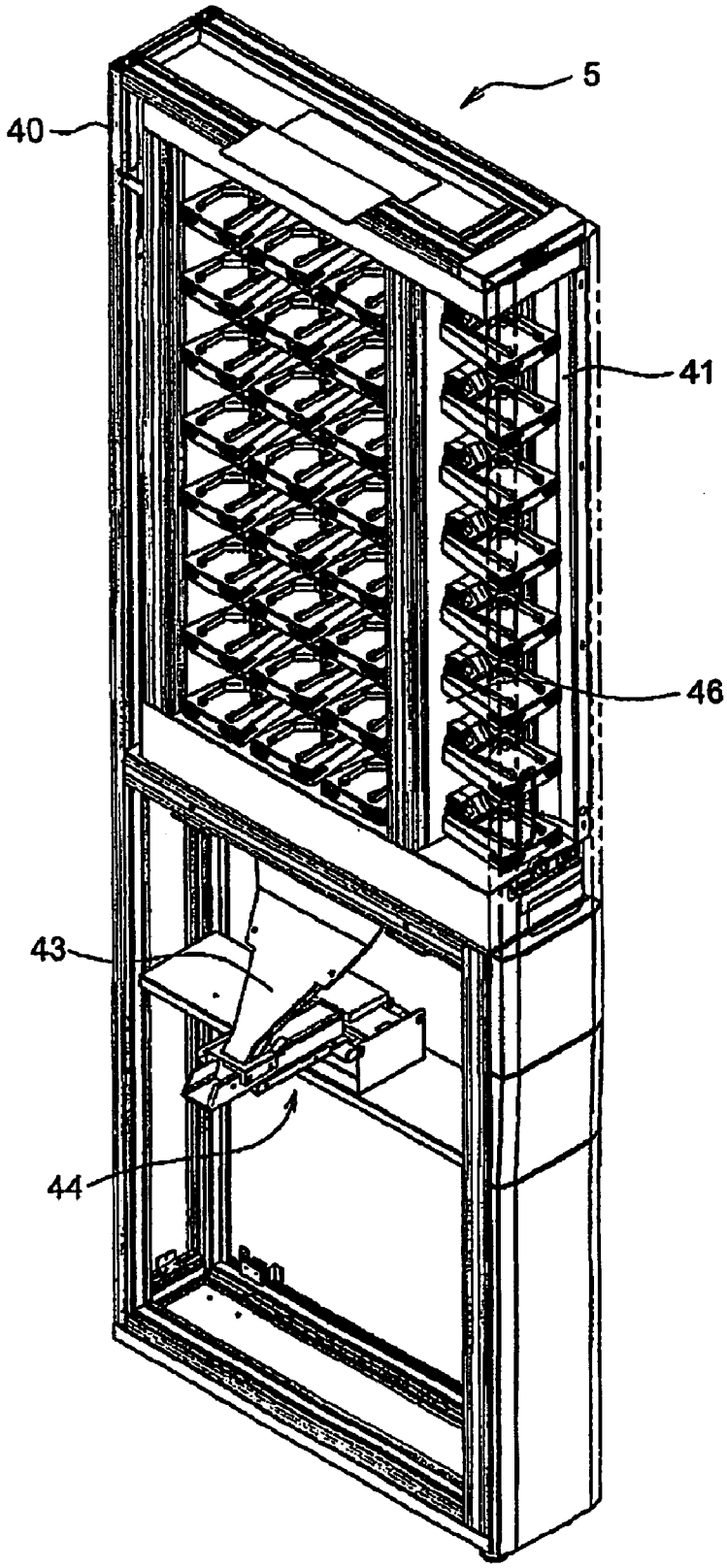
FIG. 5 is a perspective view of a sub medicine storage and removal unit.
Figure 6:
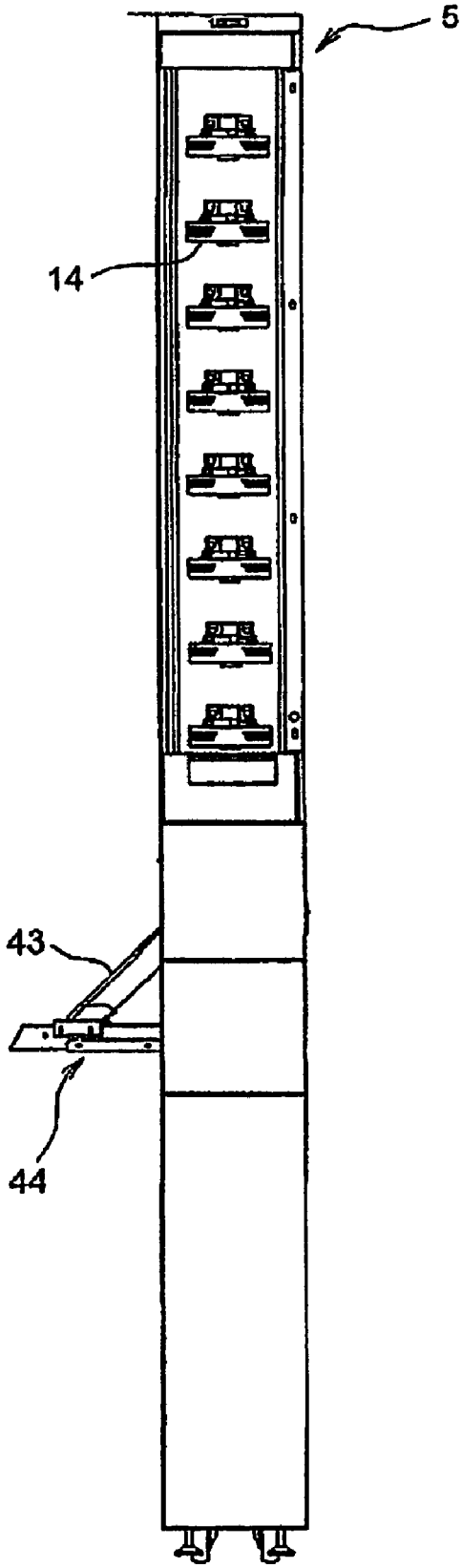
FIG. 6 is an elevation view of the sub medicine storage and removal unit with a door thereof open.
Figure 7:
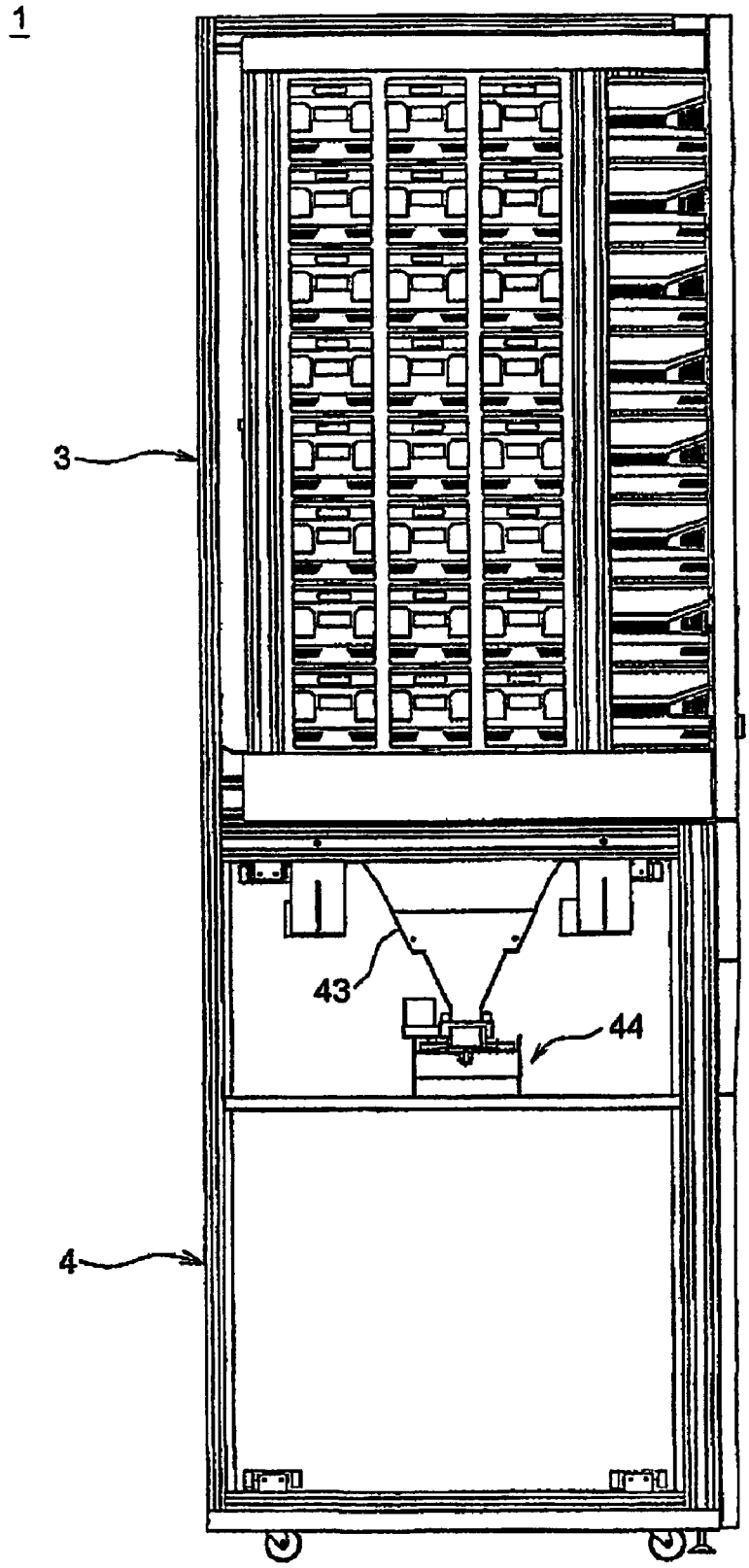
FIG. 7 is a side view of the sub medicine storage and removal unit.
Figure 8:
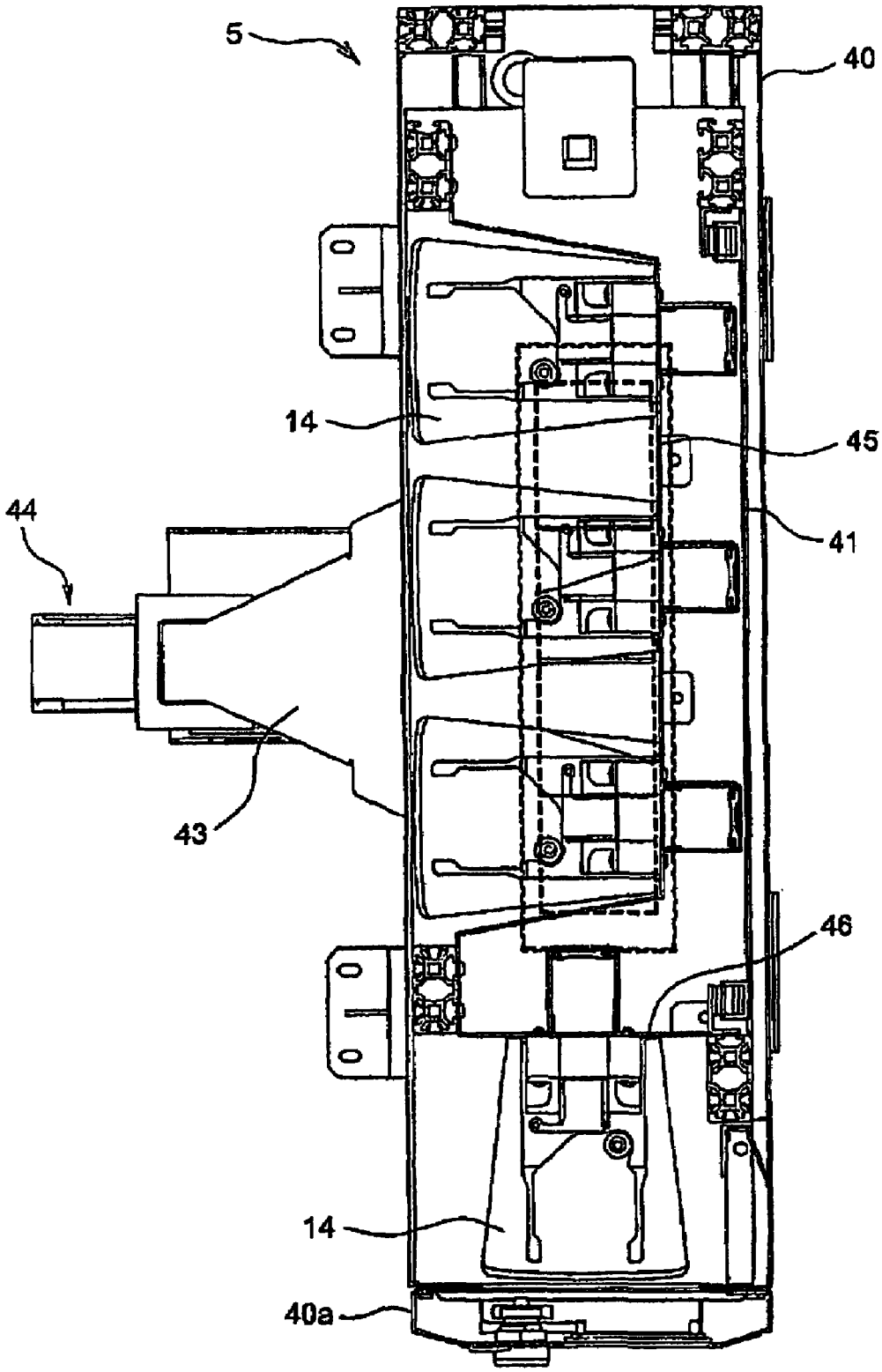
FIG. 8 is a horizontal enlarged cross section of the sub medicine storage and re oval unit.
Figure 9:
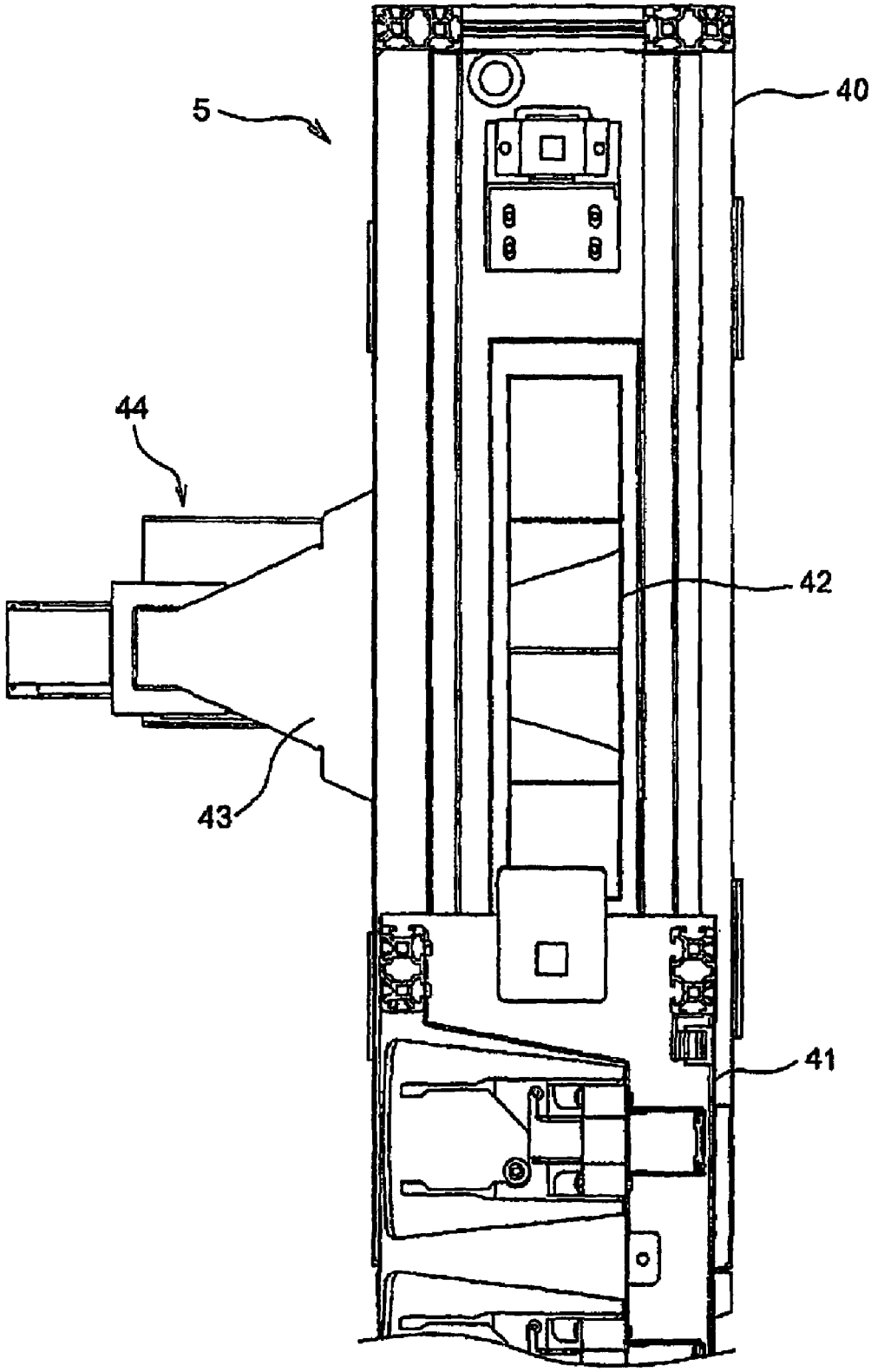
FIG. 9 is a horizontal enlarged cross section of the sub Medicine storage and removal unit with a drawer body thereof pulled out
Figure 10:
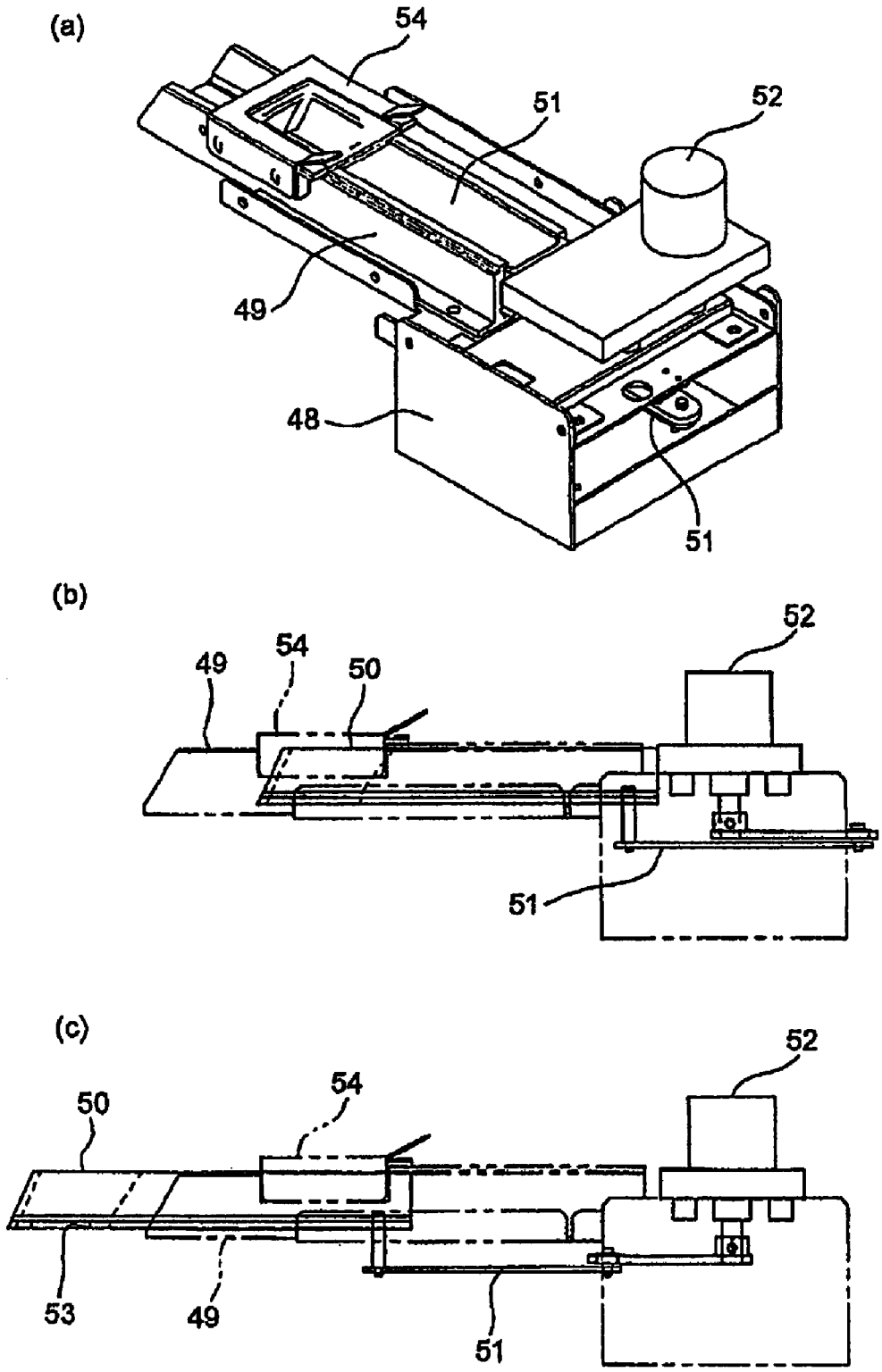
FIG. 10A is a perspective view of a medicine extruding unit of the sub medicine storage and removal unit.
FIG. 10B is a schematic elevation view of the medicine extruding unit before extruding.
FIG. 10C is a schematic elevation view of the medicine extruding unit after extruding.
Figure 11:
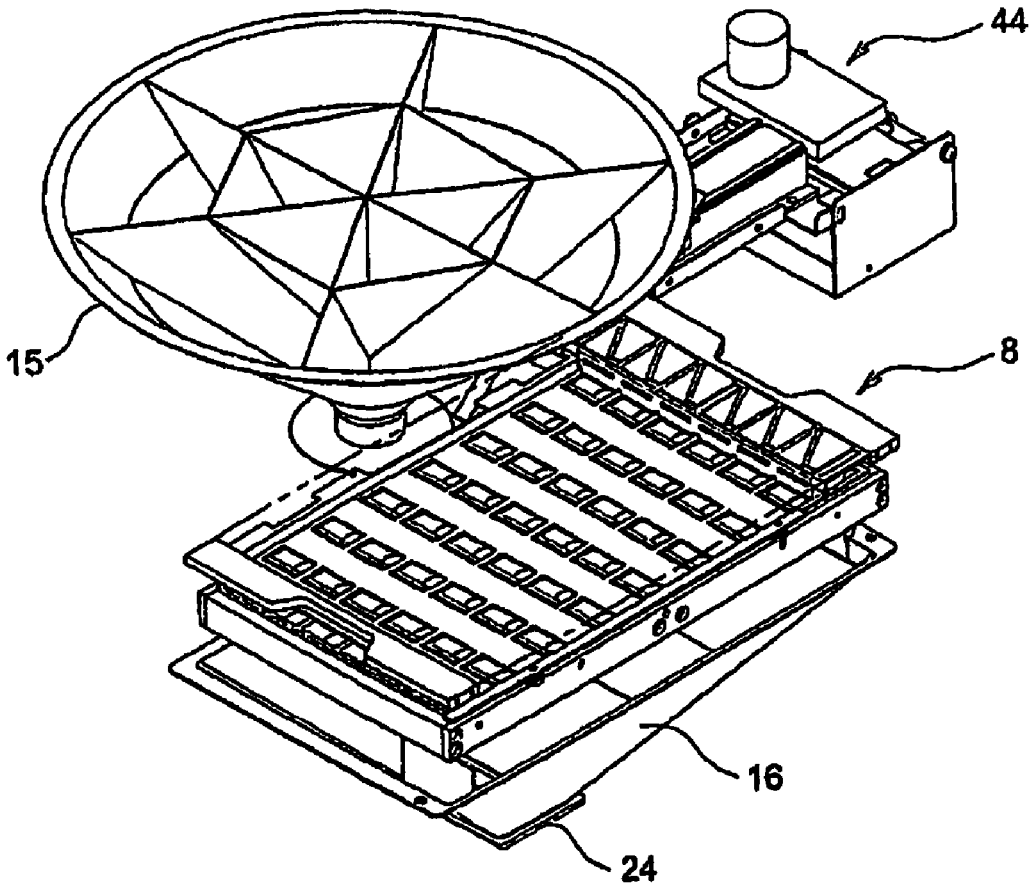
FIG. 11 is a perspective view showing the arrangement of components located above a lower collecting hopper.
Figure 12:
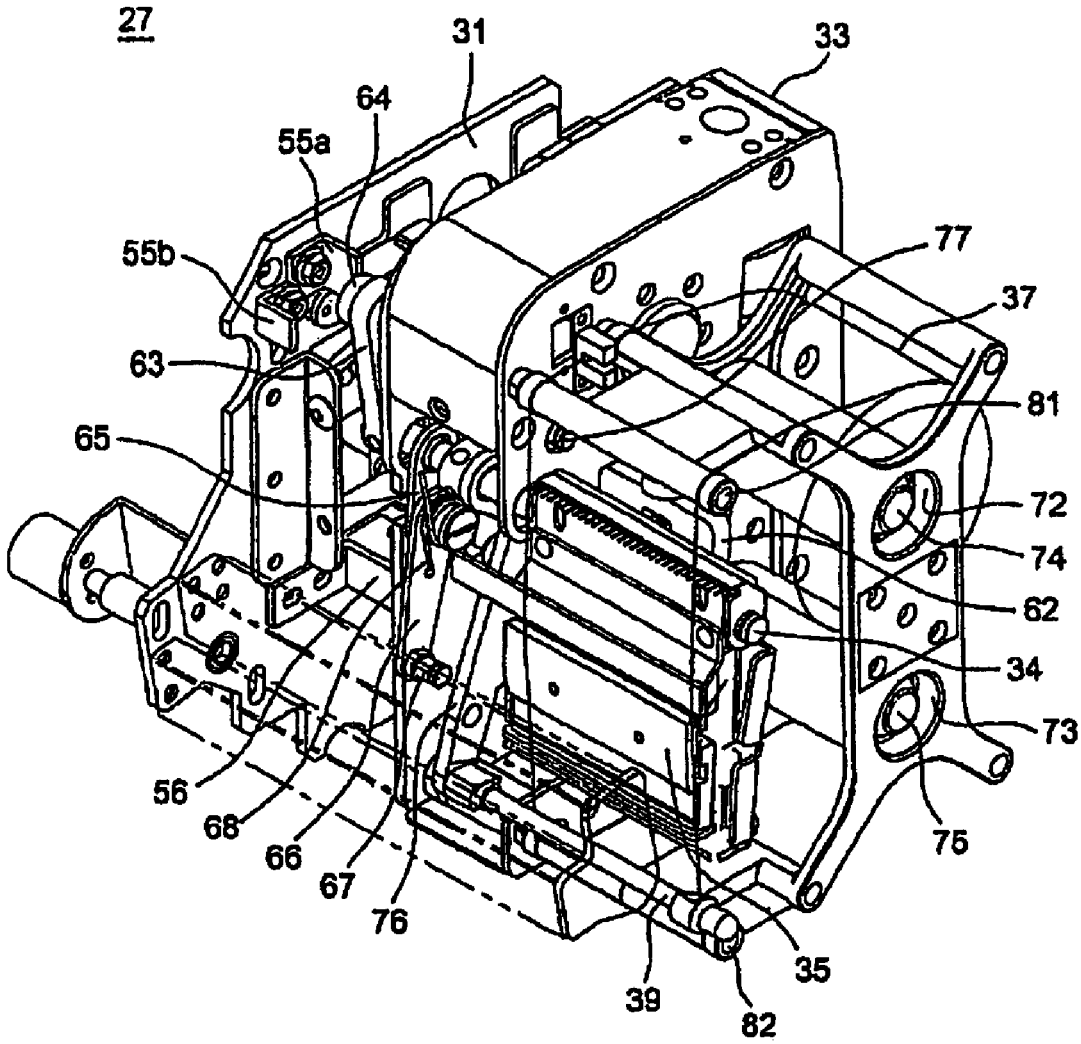
FIG. 12 is a perspective view of a printer unit.
Figure 13:
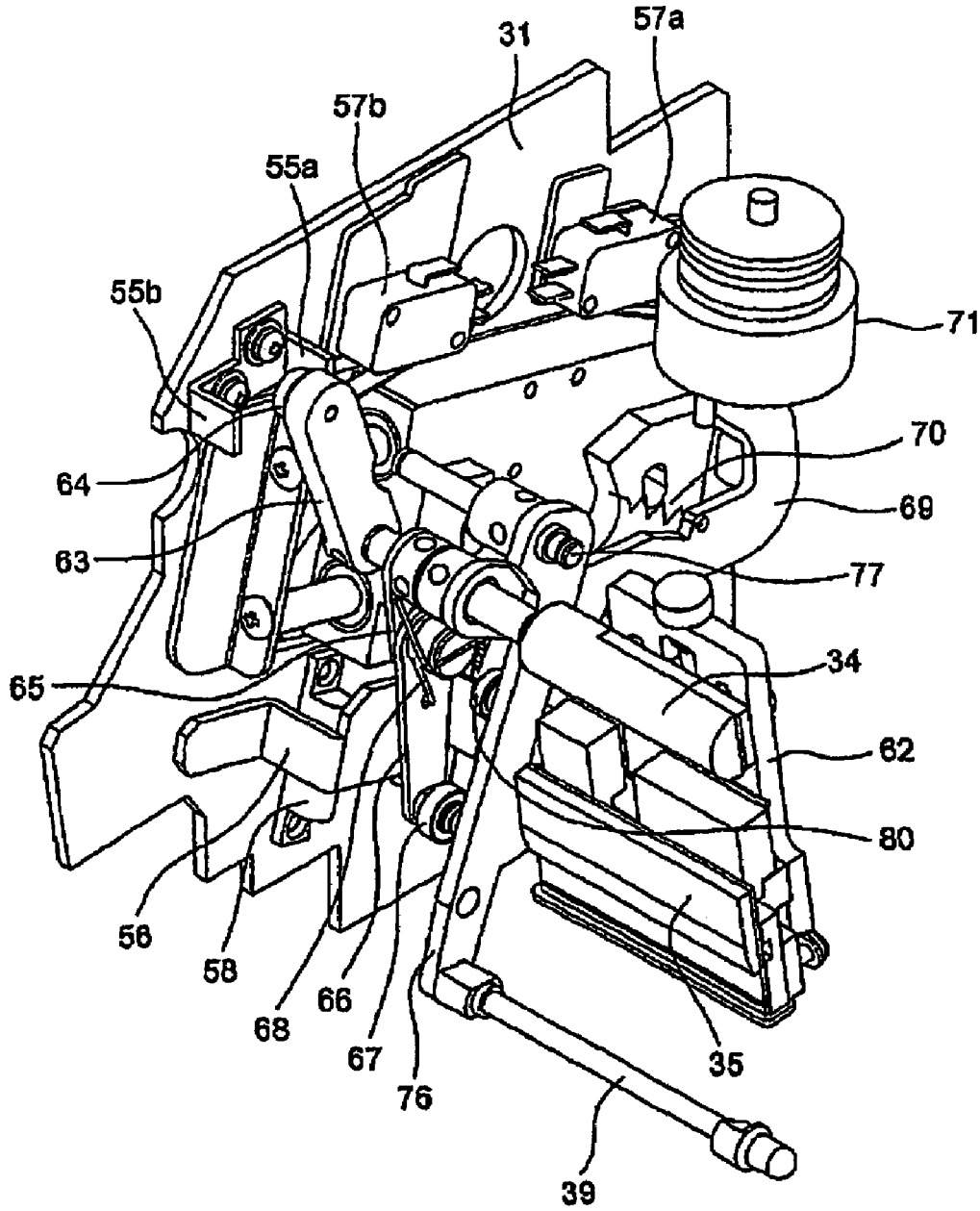
FIG. 13 is a perspective view of FIG. 12 with a movable plate of the printer unit omitted.
Figure 14:
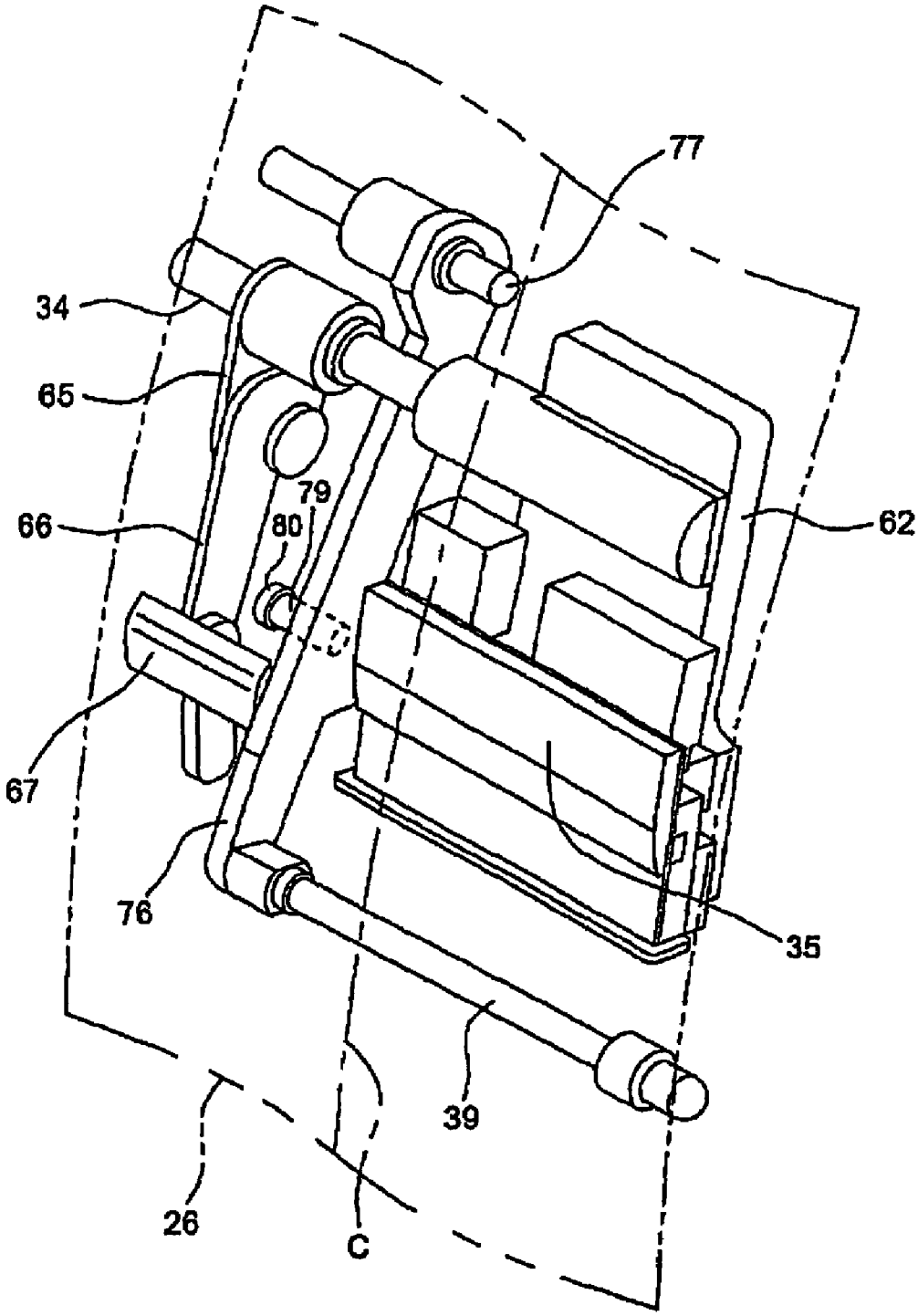
FIG. 14 is a partially enlarged perspective view of FIG. 12.
Figure 15:
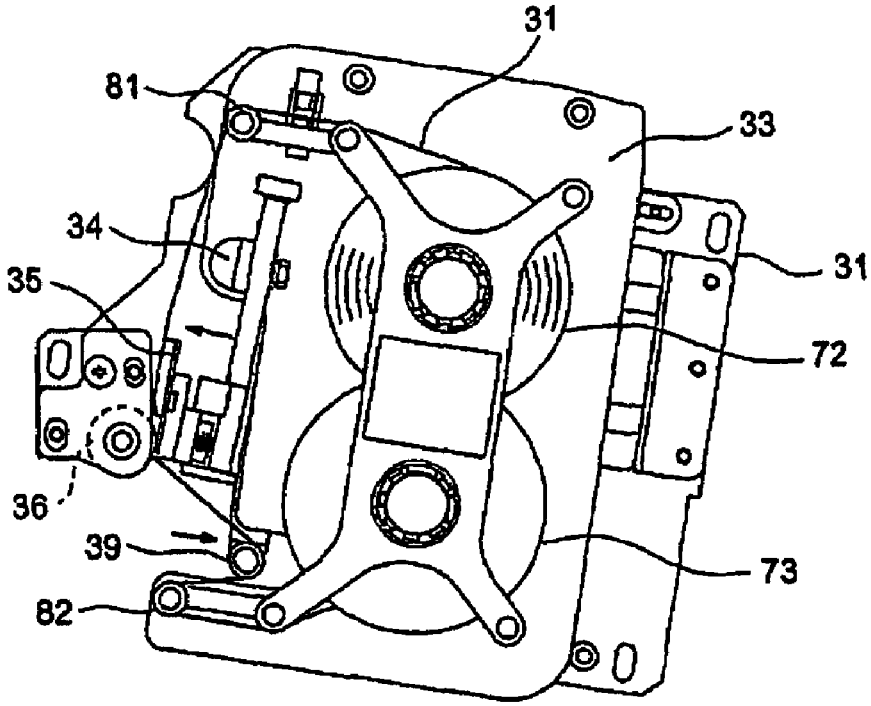
FIGS. 15A and 15B are elevation views of the printer unit, showing the fitting position and the replacement position respectively.
Figure 15:
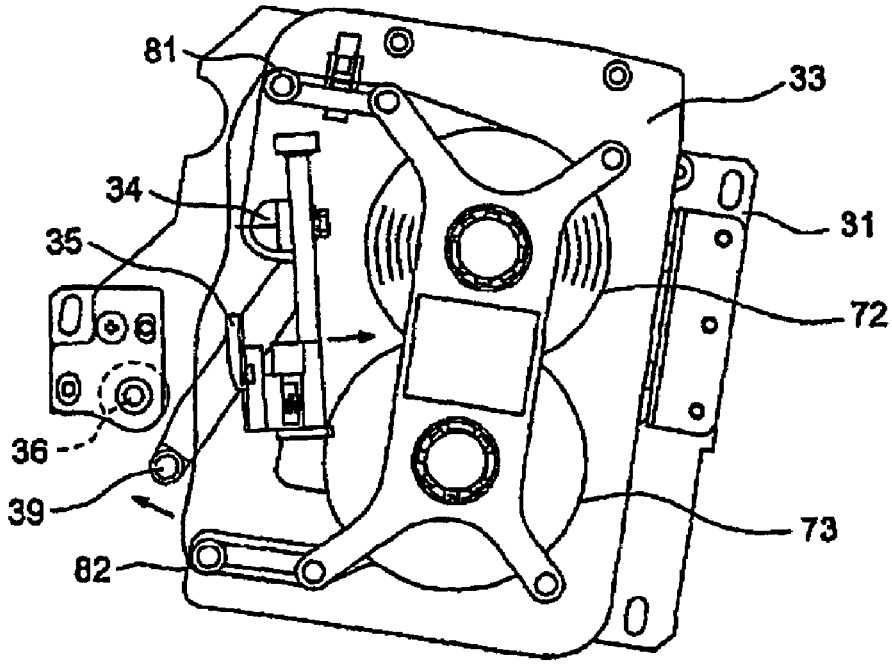
Figure 16:
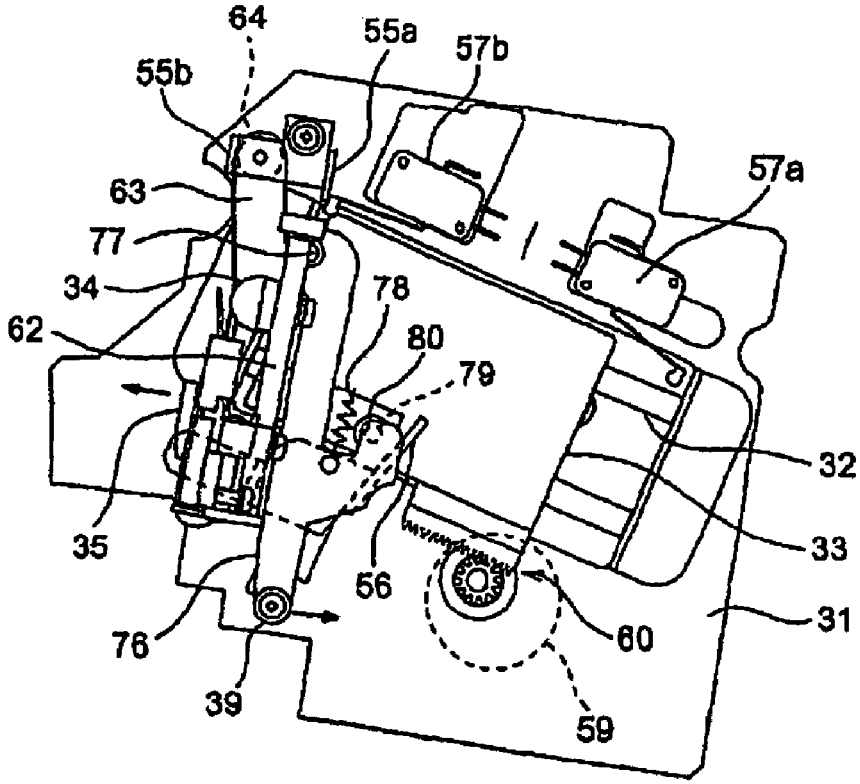
FIGS. 16A and 16B are elevation views of the printer unit with part of the movable plate omitted, showing the fitting position and the replacement position, respectively.
Figure 16:
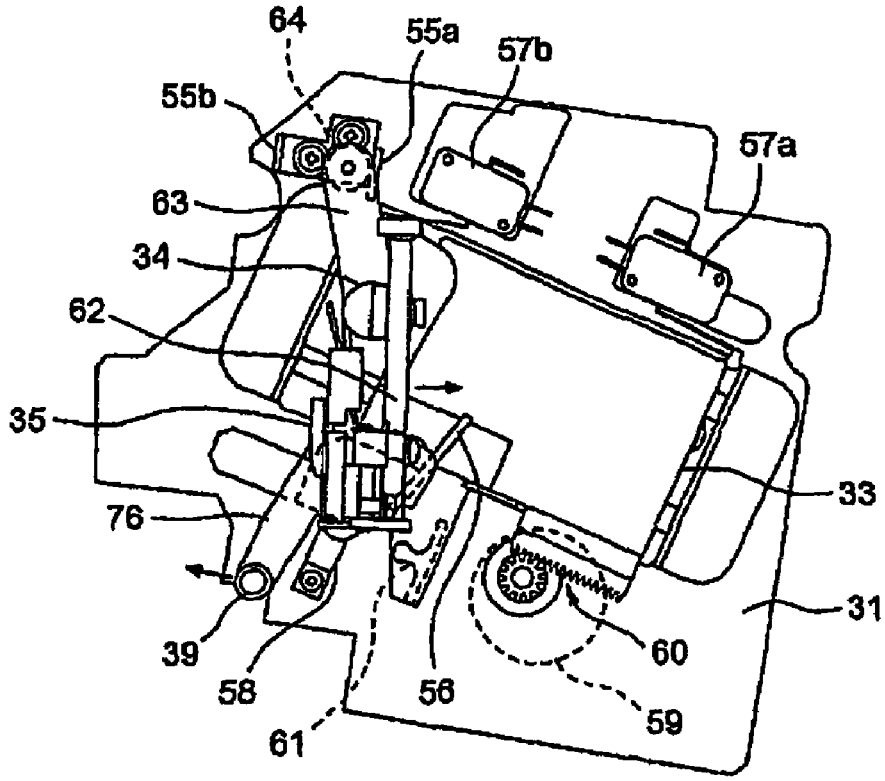

1. Medicine delivering device
2. Device body
26. Packaging paper
27. Printer unit
31. Stationary plate
33. Movable plate
34. Support shaft
35. Printer head
36. Backup roller
37. Ink tape
38. Ink ribbon
39. Tension bar
55*a*, 55*b*. First and second projecting pieces
56. Contact piece
62. Holding plate
63. Actuating lever
67. Pressing member
76. Swinging lever
77. Support shaft
78. Coil spring
79. Roller shaft
80. Roller

The invention claimed is:

1. A medicine delivering device including a printer that performs predetermined printing, by use of an ink ribbon, on a packaging paper for packaging a medicine, the medicine delivering device comprising:

a stationary member that is provided in a device body, a movable member that is movably provided to the stationary member, a printer head that is swingably provided to the movable member, a backup roller that is provided to the stationary member and that opposes the printer head, an ink ribbon that is detachably provided to the movable member and that is configured to guide an ink tape to the printer head, a tension bar that is swingably provided to the stationary member and that is configured to press the ink tape such that a tensile force is adjusted, and a swinging mechanism attached to the printer head and to the tension bar, such that when the movable member moves relative to the stationary member, the swinging mechanism swings the printer head and the tension bar in mutually opposing directions.

2. The medicine delivering device according to claim 1, wherein the movable member is provided with a pressing member that is provided adjacently to the printer head and that presses, against the backup roller, a portion of the packaging paper located on a side opposite to a side of a portion thereof opposing the printer head with respect to a line folding the packaging paper in half.

3. The medicine delivering device according to claim 2, wherein the pressing member is provided to the support shaft of the printer head and is biased by the biasing member in the direction in which the backup roller is pressed.

4. A medicine delivering device including a printer that performs predetermined printing, by use of an ink ribbon, on a packaging paper for packaging the medicine, the medicine delivering device comprising:

a stationary member that is provided in the device body, a movable member that is movably provided to the stationary member, a printer head that is swingably provided to the movable member, a backup roller that is provided to the stationary member and that opposes the printer head, an ink ribbon that is detachably provided to the movable member and that is configured to guide an ink tape to the printer head, a tension bar that is swingably provided to the stationary member and that is configured to press the ink tape such that a tensile force is adjusted, a printer head swinging mechanism configured to swing the printer head so that the printer head approaches the backup roller via the packaging paper and the ink ribbon when the movable member is moved so that the printer head approaches toward the backup roller and configured to swing the printer head so that the printer head separates from the backup roller when the movable member is moved so that the printer head retreats from the backup roller, and a tension bar swinging mechanism configured to swing the tension bar so that the tension bar presses the ink tape in a direction opposite to a direction in which the printer head moves when the movable member is moved so that the printer head advances toward the backup roller and configured to swing the tension bar so that the tension bar separates from the ink tape in the direction opposite to the direction in which the printer head moves when the movable member is moved so that the printer head retreats from the backup roller.

5. The medicine delivering device according to claim 4, wherein the printer head swinging mechanism comprises:

a holding member that holds the printer head, a support shaft that rotatably fits the holding member to the movable member and that swingably supports the printer head, an actuating lever that is fitted to the support shaft, and a first and a second projecting pieces that are fitted to the stationary member and configured to contact with a part of actuating lever when the movable member advances and retreats.

6. The medicine delivering device according to claim 5, wherein the movable member is provided with a pressing member that is provided adjacently to the printer head and that presses, against the backup roller, a portion of the packaging paper located on a side opposite to a side of a portion thereof opposing the printer head with respect to a line folding the packaging paper in half.

7. The medicine delivering device according to claim 6, wherein the pressing member is provided to the support shaft of the printer head and is biased by the biasing member in the direction in which the backup roller is pressed.

8. The medicine delivering device according to claim 4, wherein the tension bar swinging mechanism comprises:

a swinging lever that holds the tension bar and that is rotatably fitted via the support shaft to the movable member, a biasing member configured to bias the tension bar in a direction in which the ink tape is pressed, and a contact piece that is fitted to the stationary member and configured to contact with part of the swinging lever when the movable member retreats.

9. The medicine delivering device according to claim 8, wherein the movable member is provided with a pressing member that is provided adjacently to the printer head and that presses, against the backup roller, a portion of the packaging paper located on a side opposite to a side of a portion thereof opposing the printer head with respect to a line folding the packaging paper in half.

10. A medicine delivering device including a printer that performs predetermined printing, by use of an ink ribbon, on a packaging paper for packaging a medicine, the medicine delivering device comprising:

a stationary member that is provided in a device body, a movable member that is movably provided to the stationary member, a printer head that is swingably provided to the movable member, a backup roller that is provided to the stationary member and that opposes the printer head, an ink ribbon that is detachably provided to the movable member and that guides an ink tape to the printer head, a tension bar that is swingably provided to the stationary member and that presses the ink tape to thereby adjust a tensile force thereof, wherein a swinging mechanism is further provided which swings the printer head and the tension bar in mutually opposing directions when the movable member moves, wherein the movable member is provided with a pressing member that is provided adjacently to the printer head and that presses, against the backup roller, a portion of the packaging paper located on a side opposite to a side of a portion thereof opposing the printer head with respect to a line folding the packaging paper in half.

11. The medicine delivering device according to claim 4, wherein the movable member is provided with a pressing member that is provided adjacently to the printer head and that presses, against the backup roller, a portion of the packaging paper located on a side opposite to a side of a portion thereof opposing the printer head with respect to a line folding the packaging paper in half.

12. The medicine delivering device according to claim 11, wherein the pressing member is provided to the support shaft of the printer head and is biased by the biasing member in the direction in which the backup roller is pressed.

13. The medicine delivering device according to claim 10, wherein the pressing member is provided to the support shaft of the printer head and is biased by the biasing member in the direction in which the backup roller is pressed.

14. The medicine delivering device according to claim 9, wherein the pressing member is provided to the support shaft of the printer head and is biased by the biasing member in the direction in which the backup roller is pressed.

* * * * *